US008459651B1

(12) United States Patent
Nester et al.

(10) Patent No.: US 8,459,651 B1
(45) Date of Patent: Jun. 11, 2013

(54) OPEN THROAT PROJECTILE TRAP AND SHOOTING RANGE

(75) Inventors: Charles Edward Nester, Pittsfield, MA (US); Christopher John Killoy, Hampden, MA (US); Ronald Coburn, Spofford, NH (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 12/726,996

(22) Filed: Mar. 18, 2010

Related U.S. Application Data

(63) Continuation of application No. 11/733,474, filed on Apr. 10, 2007, now abandoned.

(51) Int. Cl.
*F41J 13/00* (2009.01)

(52) U.S. Cl.
USPC ..... 273/410

(58) Field of Classification Search
USPC ..... 273/403–410
See application file for complete search history.

(56) References Cited

U.S. PATENT DOCUMENTS

| | | | | | |
|---|---|---|---|---|---|
| 4,164,901 | A | * | 8/1979 | Everett | 454/228 |
| 4,512,585 | A | * | 4/1985 | Baravaglio | 273/410 |
| 4,598,631 | A | * | 7/1986 | Everett | 454/237 |
| 4,683,688 | A | * | 8/1987 | Wojcinski | 52/79.1 |
| 5,070,763 | A | | 12/1991 | Coburn | 89/36.02 |
| 5,088,741 | A | * | 2/1992 | Simonetti | 273/410 |
| 5,113,700 | A | | 5/1992 | Coburn | 89/36.02 |
| 5,121,671 | A | | 6/1992 | Coburn | 89/36.02 |
| 5,486,008 | A | | 1/1996 | Coburn | 273/410 |
| 5,535,662 | A | * | 7/1996 | Bateman | 273/410 |
| 5,718,434 | A | * | 2/1998 | Alward | 273/410 |
| 5,811,718 | A | | 9/1998 | Bateman | 89/36.02 |
| 5,902,182 | A | * | 5/1999 | Kramer | 454/255 |
| 7,264,246 | B2 | * | 9/2007 | Sovine et al. | 273/410 |
| 2003/0177895 | A1 | * | 9/2003 | Lambert et al. | 89/1.1 |
| 2005/0034594 | A1 | | 2/2005 | Parks et al. | 89/1.11 |
| 2006/0208425 | A1 | | 9/2006 | Lambert et al. | 273/410 |
| 2006/0220319 | A1 | | 10/2006 | Lambert et al. | 273/410 |
| 2007/0210522 | A1 | * | 9/2007 | Halverson | 273/404 |

OTHER PUBLICATIONS

Army Regularion 385-63 MCO 3570.1B; Range Safety Summary of Change; May 13, 2003.
Military Handbook Range Facilities and Miscellaneous Training Facilities Other Than Buildings Jun. 30, 2005.
The National Rifle Headquarters; The NRA Range Sourcebook; copyright 2007.
Design Criteria for Shooting Ranges information from the internet; undated, possible prior art.

* cited by examiner

*Primary Examiner* — Mark Graham
(74) *Attorney, Agent, or Firm* — MacCord Mason PLLC

(57) ABSTRACT

A shooting range including at least one shooting station and a projectile trap. The projectile trap includes at least two projectile trap subassemblies each having at least one end plate and joined together along adjacent end plates and a trap chamber in each of the projectile trap subassemblies, wherein a portion of the front edge of the joint between the projectile trap subassemblies is transposed into the trap chambers substantially out of view from the shooting station. In a preferred embodiment, the shooting range further includes at least one range auxiliary system.

64 Claims, 12 Drawing Sheets

OPEN THROAT PROJECTILE TRAP AND SHOOTING RANGE

This application is a continuation of application Ser. No. 11/733,474 filed Apr. 10, 2007, now abandoned.

BACKGROUND OF THE INVENTION (1) Field of the Invention

The present invention relates generally to shooting ranges of the kind including a projectile trap and, more particularly, to a projectile trap for varied uses, including for use in a shooting range.

(2) Description of the Prior Art

The design and operation of shooting ranges is a sophisticated engineering matter in which safety is paramount. Thorough discussions of the design and layout of modern shooting ranges may be found in "Design Criteria for Shooting Ranges" by C. Vargas, Third National Shooting Range Symposium (1996); Army Regulation AR 385-63 "Range Safety"; Navy Handbook (MIL-HDBK) 1027/3B, "Range Facilities and Miscellaneous Training Facilities Other Than Buildings" and the National Rifle Association's "NRA Range Source Book." These references are hereby incorporated by reference in their entirety.

Shooting ranges having projectile traps are known. Heretofore, the traps have included various apparatuses for preventing fragments of lead and other metals from escaping the traps and becoming a hazard to health and the environment. Both liquid and dry systems are popular. Examples of such systems, commonly owned by the applicant, are described in U.S. Pat. Nos. 5,070,763, 5,113,700, 5,121,671 and 5,486,008 issued to Coburn.

The construction of a shooting range with a projectile trap may be accomplished by joining individual subassembly deceleration chambers. These assemblies are generally cylindrical in shape with endplates provided for joining each deceleration chamber to an additional adjacent deceleration chamber until the desired width of projectile trap is accomplished. These cylindrical shaped deceleration chambers may leave the endplate exposed to projectile impact and visible from the shooter's perspective. This edge could be impacted by an inline projectile while the edge also may restrict horizontal cross firing, and the edge was at all times visible to the shooter.

U.S. patent application Ser. Nos. 10/317,025 filed Dec. 11, 2002 (Publication No. 2003/0177895); 11/437,469 filed May 19, 2006 (Publication No. 2006/0208425); and 11/437,231 filed May 19, 2006 (Publication No. 2006/0220319), to Lambert disclose a shooting range including a projectile trap without intervening sidewalls where the deceleration chamber is formed by a multitude of individual plates. This shooting range has not been generally accepted because of high manufacturing costs associated with fixing large numbers of individual plates to adjoining plates.

Thus, there remains a need for a new and improved shooting range having at least one shooting station and at least two projectile traps adapted to be joined together along adjacent ends in a manner which provides for substantially unobstructed horizontal cross firing while, at the same time, the front edges of the joint between the projectile traps are substantially out of view from the shooting station.

SUMMARY OF THE INVENTION

The present inventions are directed to a shooting range including at least one shooting station and a projectile trap.

The projectile trap includes at least two projectile trap subassemblies each having at least one end plate and joined together along adjacent end plates and a trap chamber in each of the projectile trap subassemblies, wherein a portion of the front edge of the joint between the projectile trap subassemblies is transposed into the trap chambers substantially out of view from the shooting station. In a preferred embodiment, the shooting range further includes at least one range auxiliary system.

In a preferred embodiment, the transposed portion of the front edge of the joint between the projectile trap subassemblies is about 90° downstream from the entrance to said trap chamber. The transposed portion of the front edge of the joint between the projectile trap subassemblies may be the portion of the front of the projectile trap subassemblies not protected by the trap guide.

Also, the present inventions may, further include a trap guide for directing a projectile into the trap chambers and protecting the front edge of said projectile trap subassemblies. The trap guide may include at least one pair of opposed ramps. In a preferred embodiment, the angle of each ramp is between about 5° and 25° from horizontal.

In a preferred embodiment, the end plates are joined together by at least one fastener assembly. A seam protector attached to the intersection of the exposed and displaced seam surface between adjacent end plates may also be included. The seam protector may be an overlapping abrasion resistant plate.

In a preferred embodiment, the trap chamber is a deceleration chamber. The deceleration chamber may further include an inlet and inner curved surface for receiving the projectile wherein the velocity of the projectile is reduced by contact with the inner surface. The deceleration chamber may further include an exit for decelerated projectiles. An embodiment of the trap chamber may further including a projectile retrieval system. In addition, the projectile trap may include at least one secondary support to support the projectile trap.

In certain embodiments, the projectile trap further includes an air injection system and an air collection system positioned downstream of the air injection system for receiving at least a portion of the air from the air injection system. The air injection system includes an air supply and at least one air outlet, where the air outlet may include a plurality of spaced apart air outlets, whereby the plurality of spaced apart air outlets are slots. At least one of these air outlets is oriented towards the trap chamber. The air collection system includes at least one air inlet, where at least one air inlet includes a plurality of spaced apart air inlets, whereby the plurality of spaced apart air inlets are slots. At least one air inlet is oriented towards the trap chamber. The air collection system also includes at least one exhaust fan and may include at least one air filter. In addition, the operating CFM of the air collection system is greater than or equal to the operating CFM of the air injection system.

In an embodiment, the shooting range may include a range auxiliary system, the range auxiliary system possibly being a targeting system, a containment system that may contain side walls, a safety ceiling and overhead baffles, and/or an HVAC system. Furthermore, the shooting range may also include a firing position, or may include a shooting booth, or possibly include a weapon rest and/or at least one lane divider.

Accordingly, one aspect of the present invention is to provide a shooting range including: (a) at least one shooting station; and (b) at least two projectile traps joined together along adjacent ends wherein the front edge of the joint between the projectile traps includes a backwardly transposed portion substantially out of view from the shooting station Another aspect of the present invention is to provide an improved projectile trap for a shooting range having at least one shooting station including: (a) at least two projectile trap subassemblies each having at least one end plate and joined together along adjacent end plates; and (b) a trap chamber in each of the projectile trap subassemblies, wherein a portion of the front edge of the joint between the projectile trap subassemblies is transposed into the trap chambers substantially out of view from the shooting station.

Still another aspect of the present invention is to provide a shooting range including: (a) at least one shooting station; (b) a projectile trap including (i) at least two projectile trap subassemblies each having at least one end plate and joined together along adjacent end plates and (ii) a trap chamber in each of the projectile trap subassemblies, wherein a portion of the front edge of the joint between the projectile trap subassemblies is transposed into the trap chambers substantially out of view from the shooting station; and (c) at least one range auxiliary system.

These and other aspects of the present invention will become apparent to those skilled in the art after a reading of the following description of the preferred embodiment when considered with the drawings.

DESCRIPTION OF THE PREFERRED EMBODIMENTS

Figure 1:
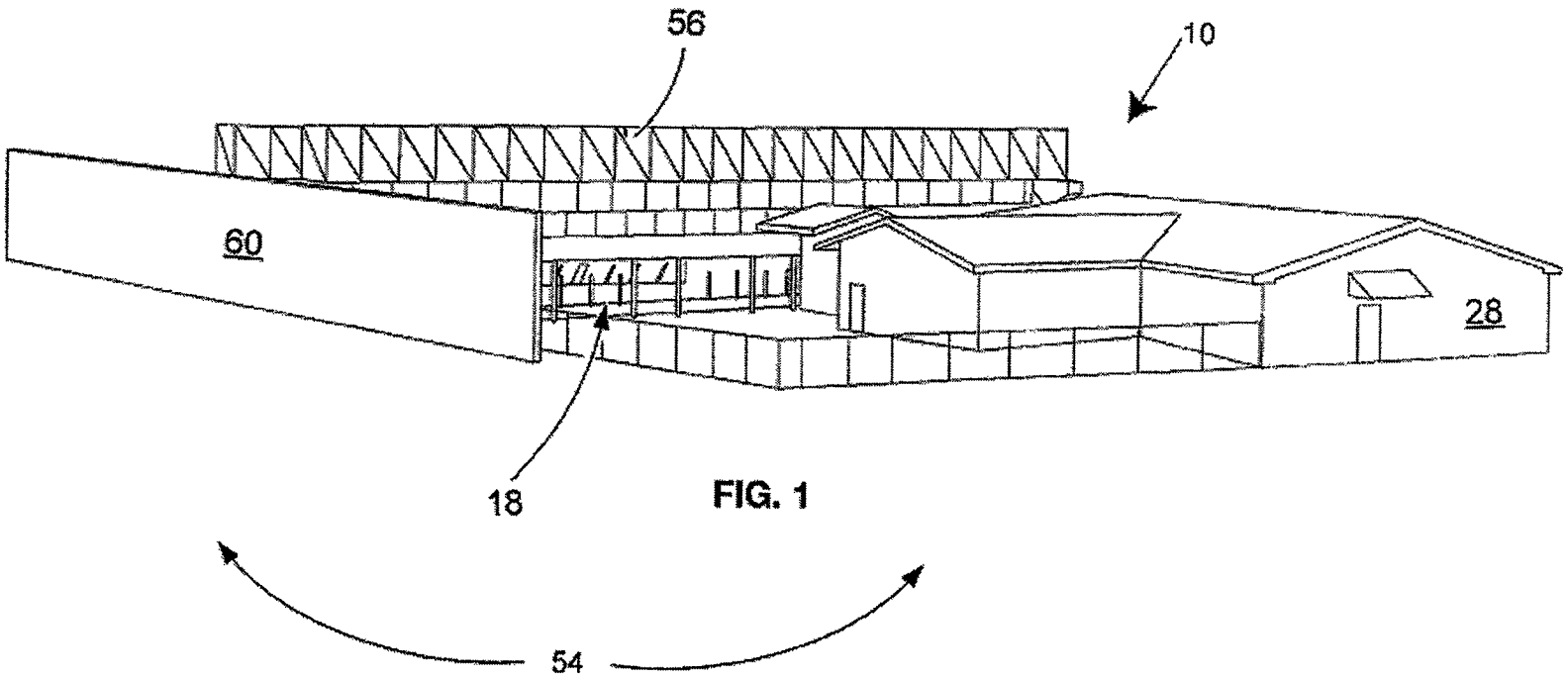
FIG. 1 is a top perspective view of a shooting range constructed according to the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a shooting range, generally designated 10, is shown constructed according to the present inventions. The shooting range 10 includes an administrative facility 28 which may include a safety area where firearms may be inspected and readied. In addition, range management may have offices adjacent or in the safety area. Limited access to the shooting range 10 may be provided by additional fencing and supplemented, in part, by a containment system, generally designated 54.

Figure 2:
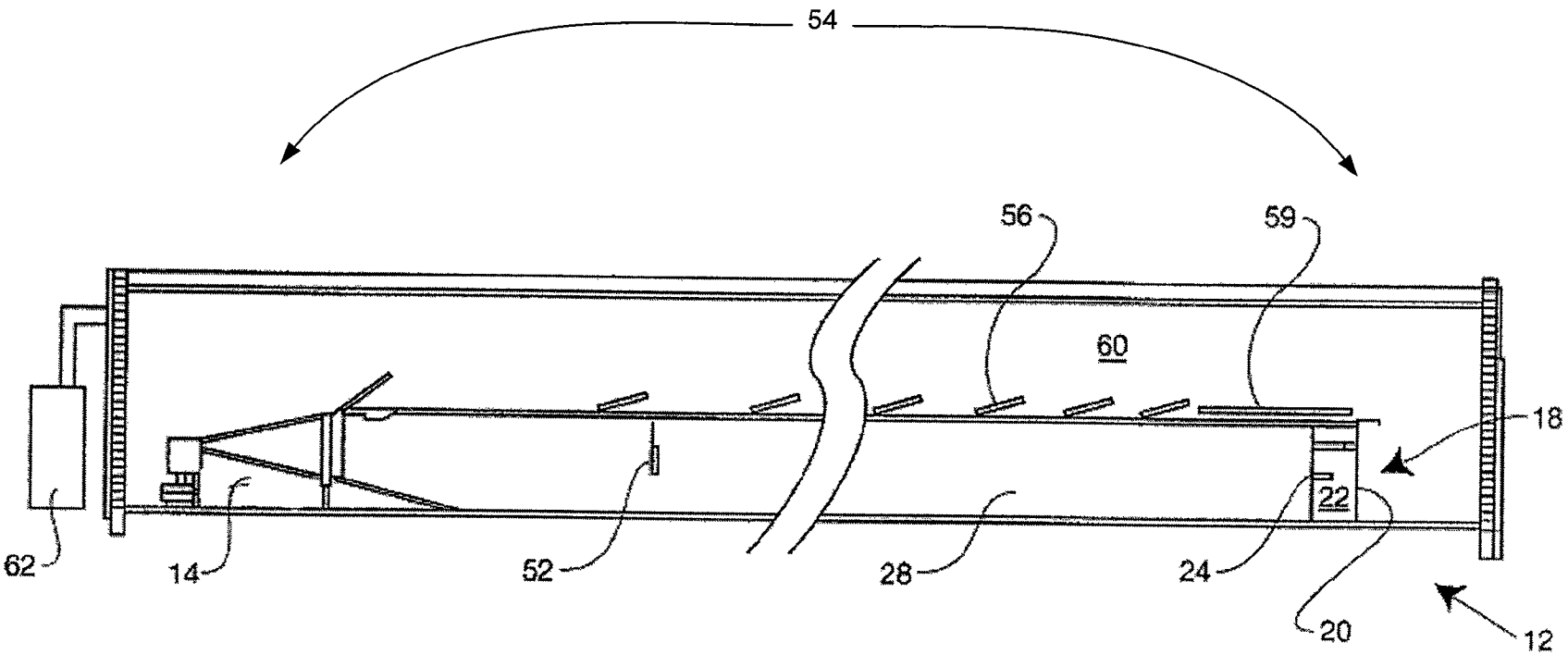
FIG. 2 is a cross-sectional side view of a portion of the shooting range.

FIG. 2 is a cross-sectional view of a portion of shooting range 10. FIG. 2 shows a shooting station 12, a projectile trap 14 and at least one range auxiliary system that may include: a targeting system 52; a containment system 54 that may optionally include one or more sidewalls, such as the wall 60, overhead baffles 56, and or a safety ceiling 59; or a heating ventilation air conditioning (HVAC) system 62 and combinations thereof. The shooting station 12 may include one or more of a firing position 18 and a shooting booth 20 that may optionally include a weapon rest 24 and or a lane divider 22.

Figure 3:
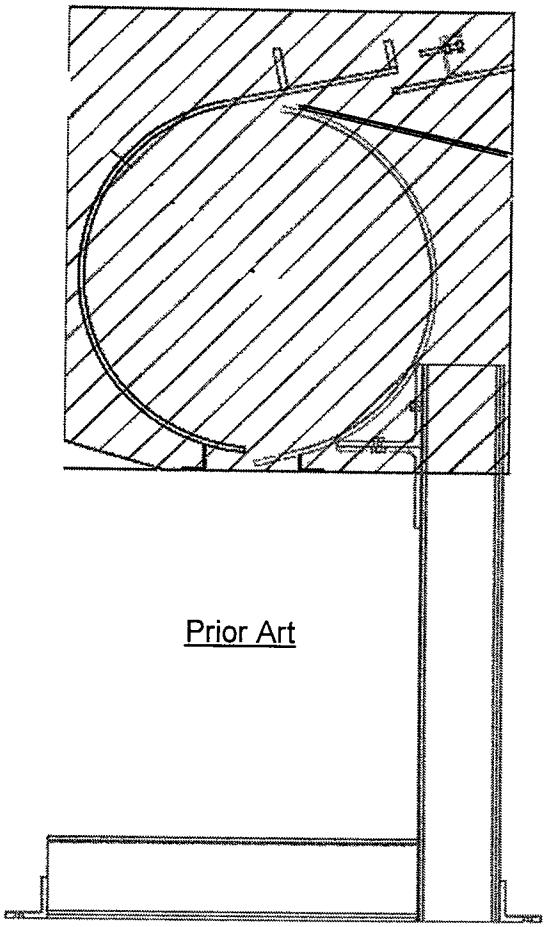
Prior Art FIG. 3
FIG. 3 is an enlarged cross-section side view of a prior art projectile trap for use in the shooting range.

FIG. 3 is an enlarged cross-section side view of a prior art projectile trap for use in the shooting range.

Figure 4:
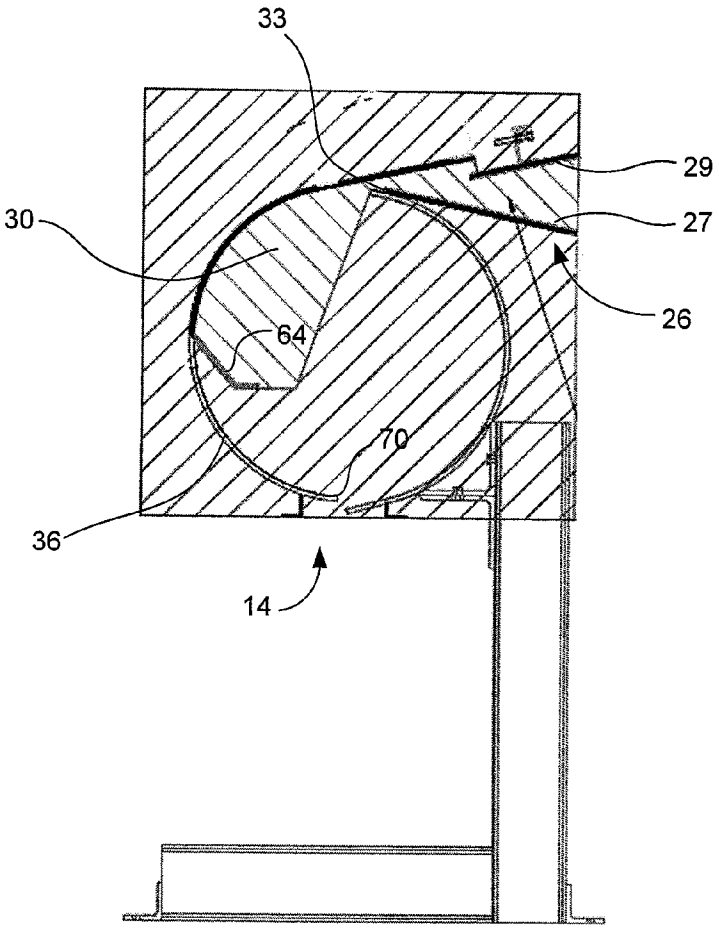
FIG. 4 is an enlarged cross-section side view of a projectile trap for use in the shooting range of the present inventions.

FIG. 4 is an enlarged cross-section side view of a projectile trap for use in the shooting range of the present inventions. FIG. 4 shows a projectile trap 14 including a trap chamber 30. In an embodiment of the projectile trap 14, the chamber 30 includes an inlet 33 and an inner curved surface 36 for receiving a projectile and reducing its velocity through contact with the surface 36. In a further embodiment, the trap chamber includes a trap guide 26 for directing projectiles into projectile trap 14 and protecting the front portions of the projectile trap 14. This trap guide 26 may be formed by a pair of opposing ramps as shown with upper ramp 29 and lower ramp 27. In an embodiment, the projectile trap may also include a seam protector 64 for deflecting projectiles away from the intersection of the exposed and displaced seam surface formed by the junction of adjoining projectile traps. The trap chamber may also include an exit 70 for decelerated projectiles.

Figure 5:
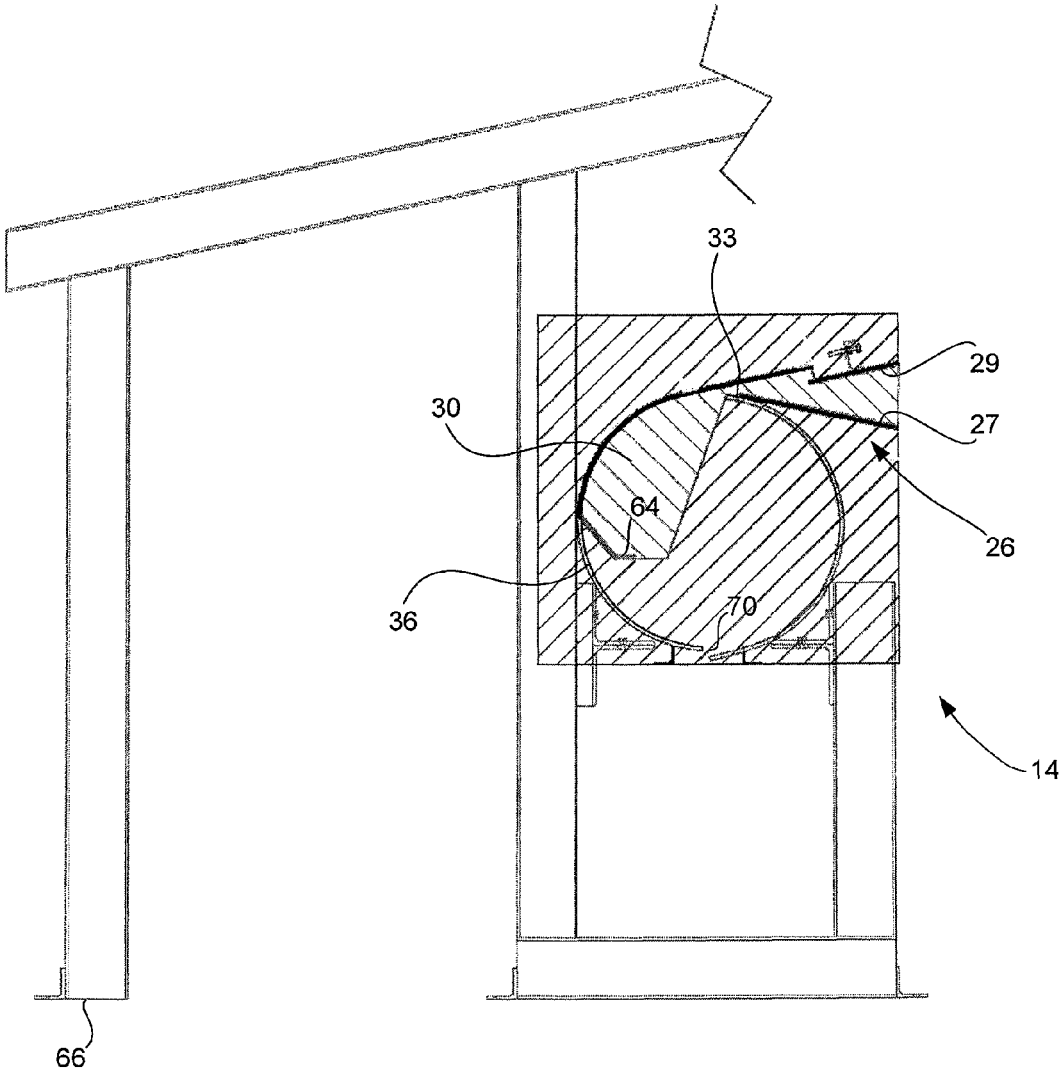
FIG. 5 is an enlarged cross-section side view of an alternate embodiment of a projectile trap for use in the shooting range of the present inventions.

FIG. 5 is an enlarged cross-section side view of an alternate embodiment of a projectile trap for use in the shooting range of the present inventions. In this embodiment, the shooting range further includes a secondary support 66 to support portions of the trap chamber. This secondary support may be used to provide substantial support to allow the trap chamber to be free standing and not require overhead support.

Figure 6:
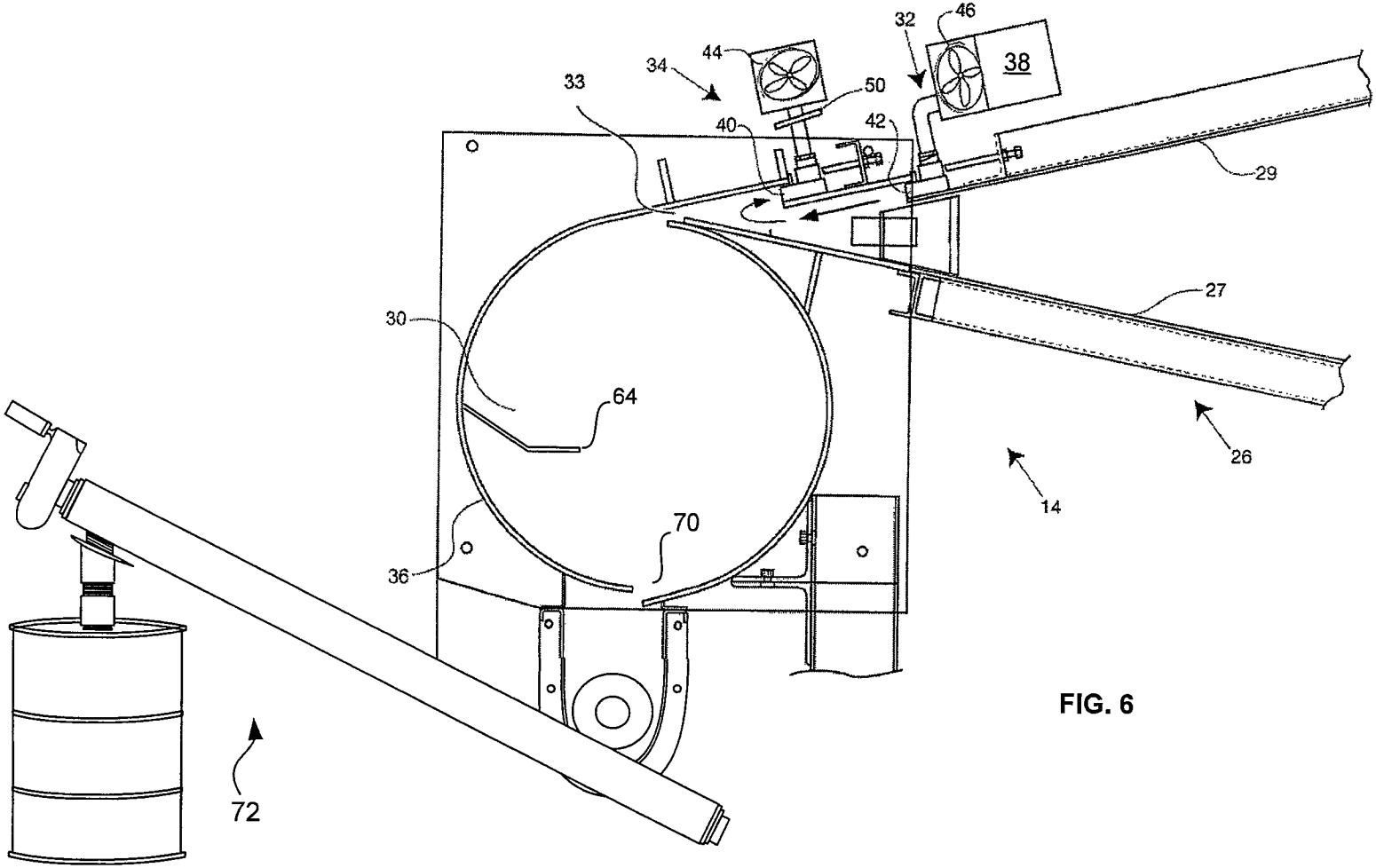
FIG. 6 is an enlarged cross-section side view of another alternative embodiment of a projectile trap for use in the shooting range of the present inventions.

FIG. 6 shows a projectile trap 14 including a trap chamber 30, an air injection system 32 positioned upstream, in reference to the direction of projectile travel, of the trap chamber 30, and an air collection system 34 downstream of the injection system 32 that may optionally include an air filter 50. In an embodiment of the projectile trap 14, the chamber 30 includes an inlet 33 and an inner curved surface 36 for receiving a projectile and reducing its velocity through contact with the inner curved surface 36. The injection system 32 shown may include an air supply 38, air inlets, such as the inlet 42, which is shaped as a slot and oriented toward the chamber 30, and air outlets, such as the outlet 40, which is also shaped as a slot and is also oriented towards the chamber 30. The collection system 34 may optionally include an exhaust fan 44 having an operating CFM equal to or greater than that of an injection fan 46 to aid in controlling the direction and velocity of the air from the air injection system.

Figure 7:
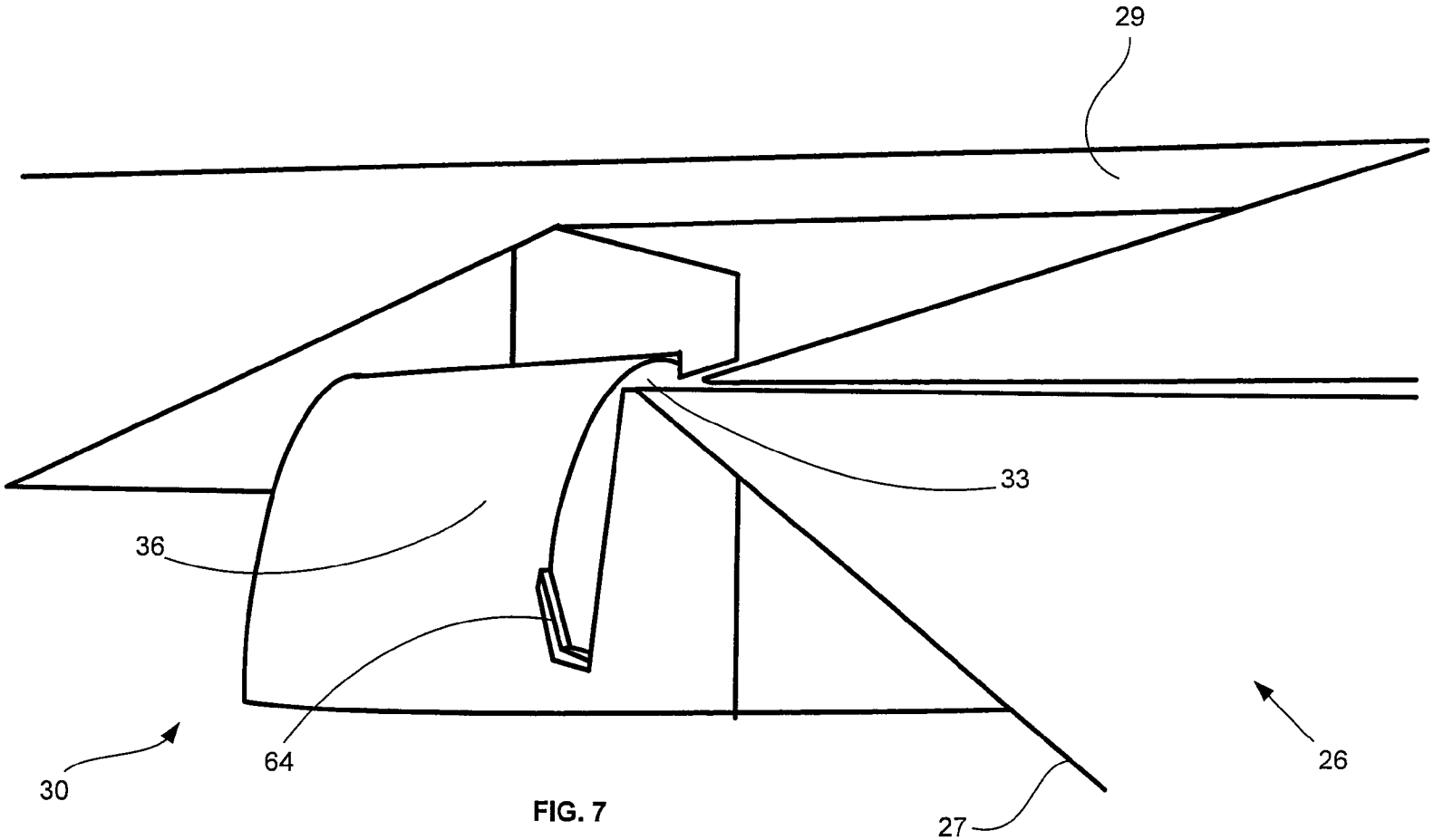
FIG. 7 is an enlarged isometric view of a projectile trap for use in the shooting range of the present inventions.

FIG. 7 is an enlarged isometric view of a projectile trap for use in the shooting range of the present inventions. In this embodiment, the projectile trap further includes a trap guide 26. The guide 26 may be a pair of opposed ramps 27 and 29. In an embodiment of the projectile trap, the trap chamber 30 includes an inlet 33 and an inner curved surface 36 for receiving a projectile and reducing its velocity through contact with the inner curved surface 36. The projectile trap may further include a seam protector 64.

Figure 8:
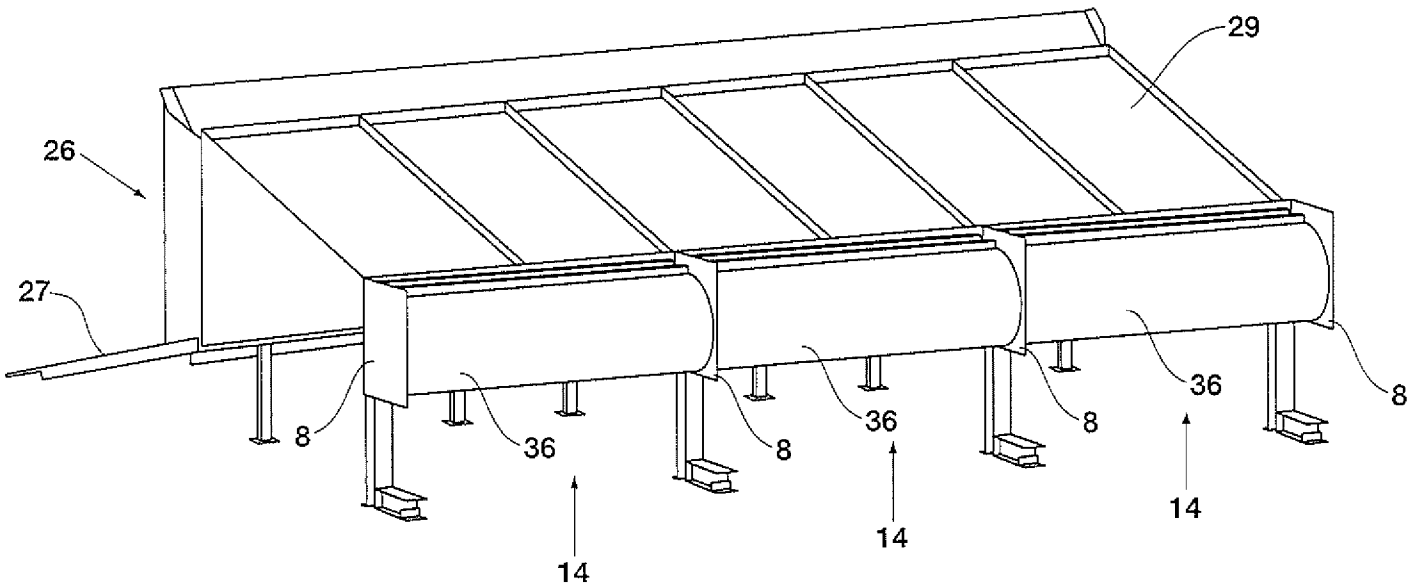
FIG. 8 is an enlarged rear perspective view of a projectile trap for use in the shooting range of the present inventions.
Figure 9:
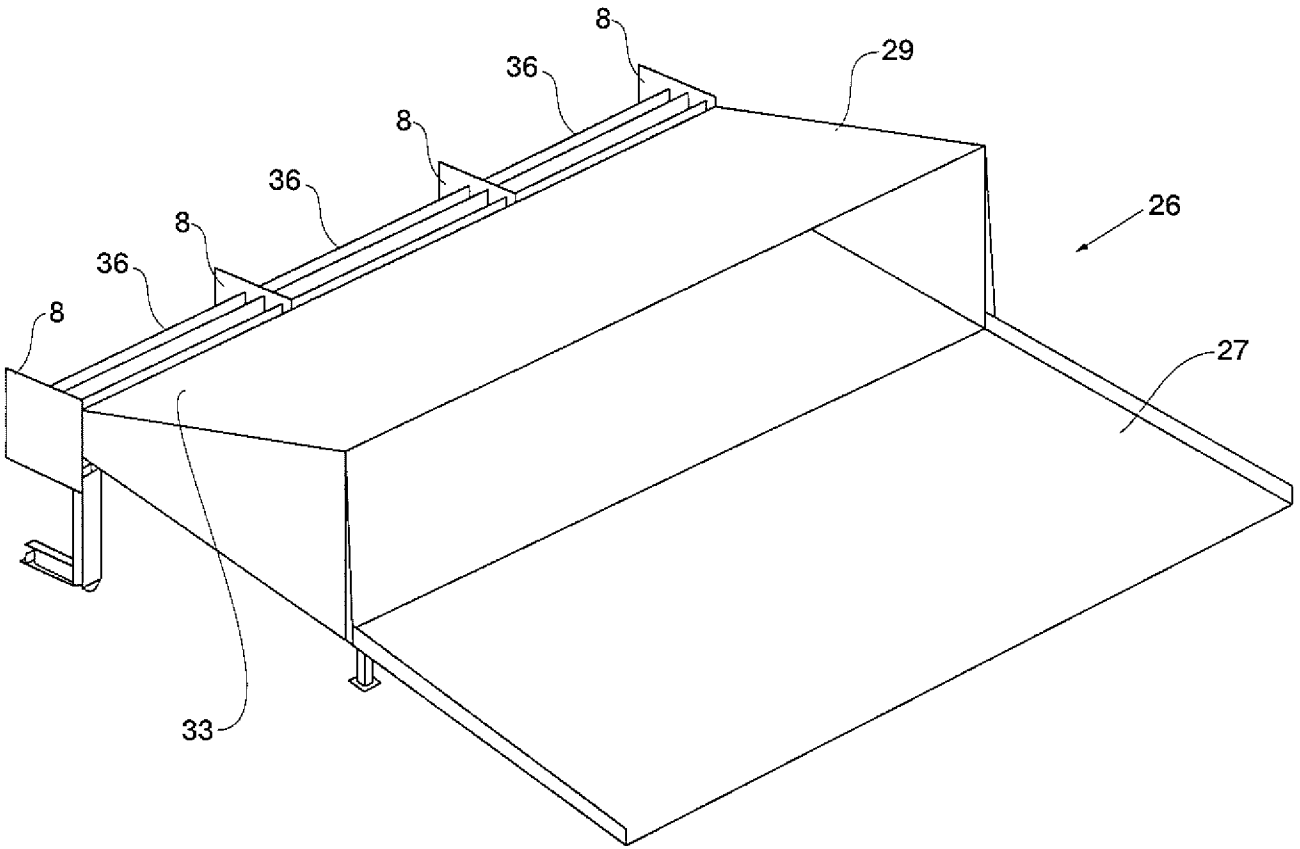
FIG. 9 is an enlarged front perspective view of a projectile trap for use in the shooting range of the present inventions.

FIGS. 8 and 9 show perspective views of exemplary embodiments of a series of projectile traps 14, including inner curved surfaces 36 and end plates 8, used in the shooting range of the present inventions. As shown, the end plates 8 on the projectile traps 14 may provide support. In particular, the end plates 8 may provide support at the distal ends of the projectile traps 14.

Figure 10A:
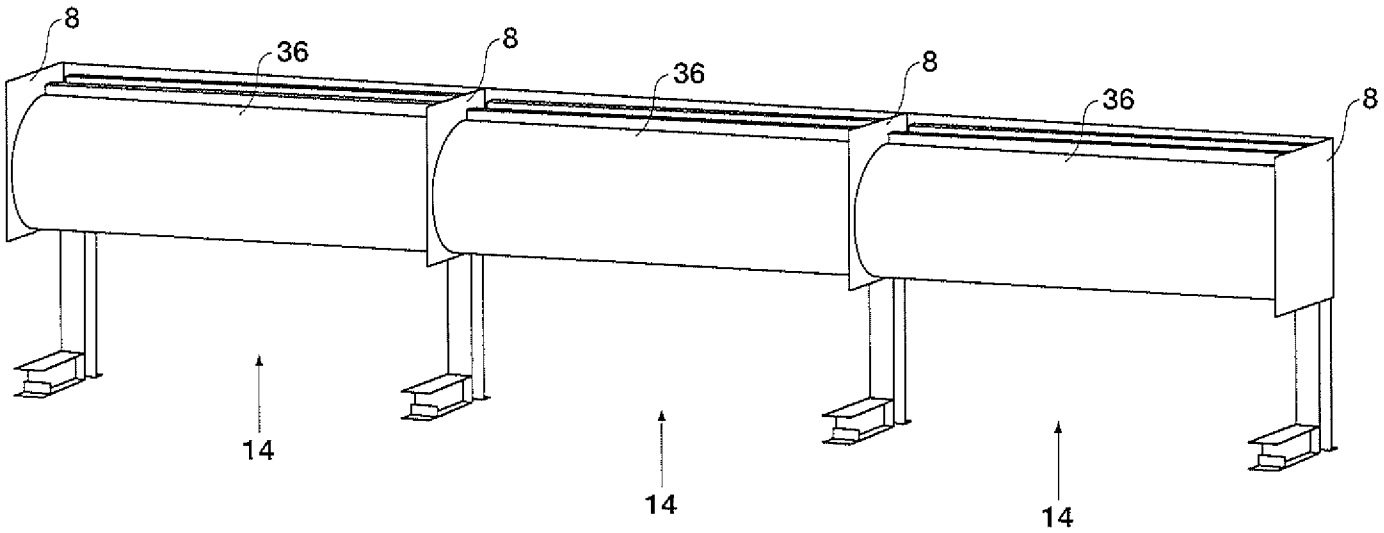
FIG. 10*a* is an enlarged rear perspective view of a series of trap assemblies as seen in FIG. 4.
Figure 10B:
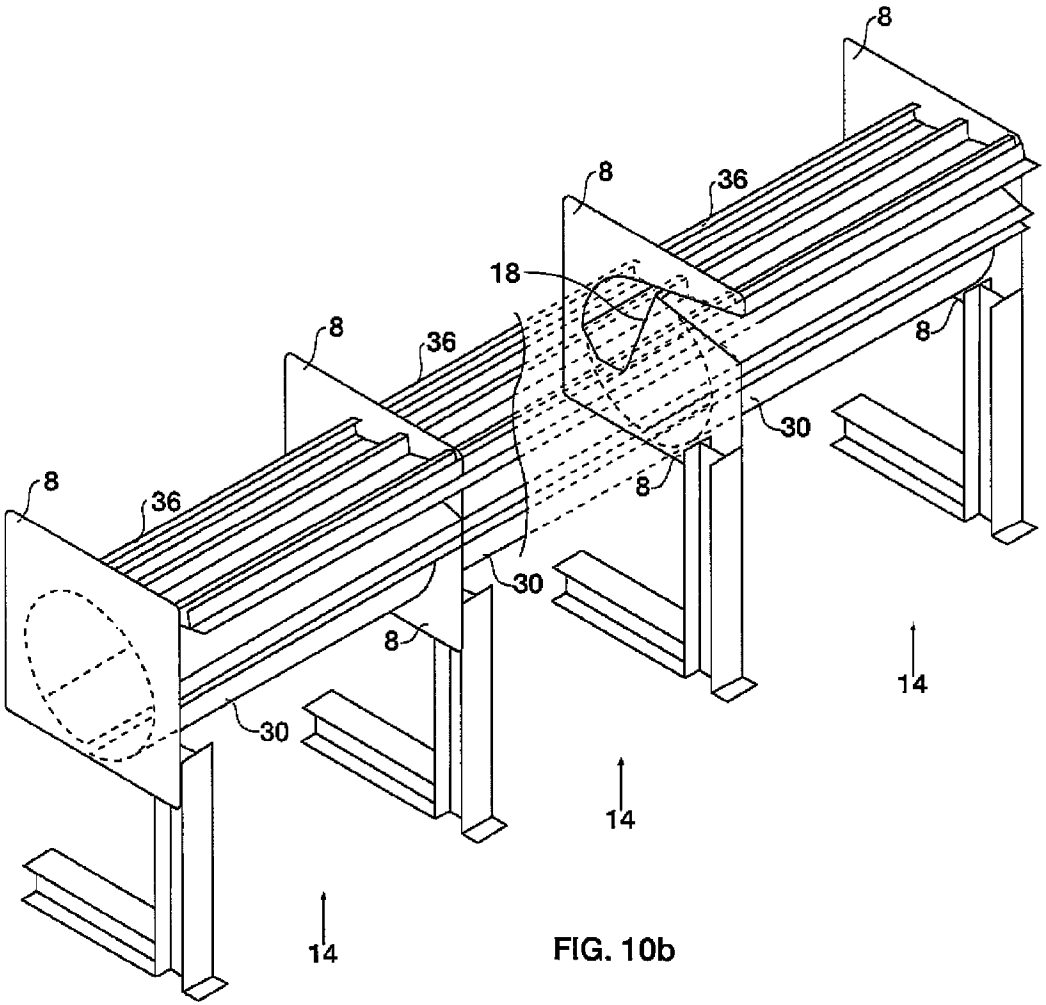
FIG. 10*b* is an enlarged front perspective view of a series of trap assemblies as seen in FIG. 4 with certain elements shown in phantom.
Figure 10C:
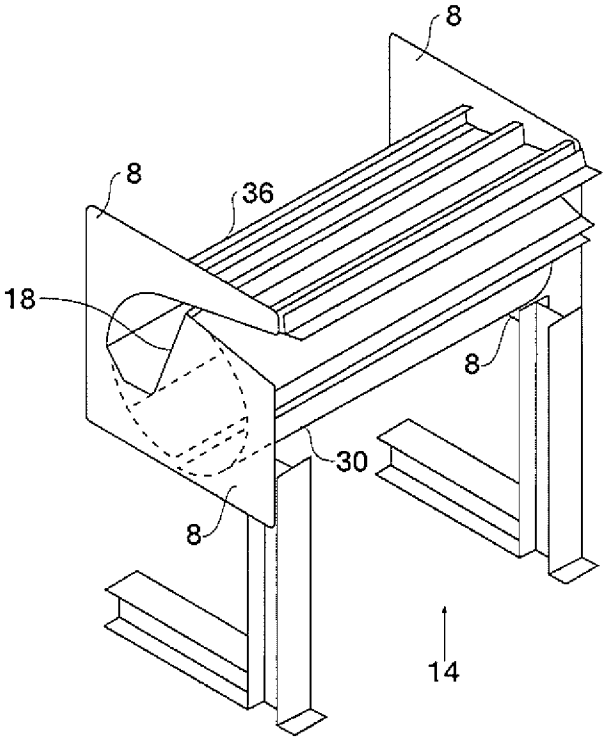
FIG. 10*c* is an enlarged front perspective cutaway view a trap assembly as seen in FIG. 10*b*.

FIGS. 10*a*, 10*b* and 10*c* illustrate cut-away views of the projectile traps 14, with elements of the trap guide 26 and the projectile traps 14 shown in phantom. FIG. 10*a* shows a rear-perspective view of one embodiment of the series of projectile traps 14. The projectile traps 14 may include the curved surface 36, typically for receiving a projectile and reducing its velocity through contact with the surface 36. Typically, the end plates 8 provide support for each projectile trap 14. In particular embodiments, the end plates 8 provide support at the distal ends of each trap 14. Similarly, FIGS. 10*b* and 10*b* show front-perspective views of embodiments of the series of projectile traps 14. Typically, a portion of the front end of the joint 18 formed by joining together adjacent plates 8 may be transposed into trap camber 30. In this particular embodiment, the transposed portion of the front edge of the joint 18 between the projectile traps 14 is the portion that is typically not protected by the trap guide 26.

In one embodiment, the projectile trap 14 may also include a trap guide 26 wherein the injection system 32 is adjacent the guide 26 and the collection system 34 is upstream of the chamber 30. The guide 26 may be a pair of opposed ramps 27 and 29 with each ramp having an angle between about 5° and 25° from horizontal. In addition, the trap chamber may further include an exit 70 for decelerated projectiles. In an alternative embodiment, the trap may further include a projectile retrieval system 72 for disposing of fired projectiles. The projectile trap may further include a seam protector 64.

Certain modifications and improvements may occur to those skilled in the art upon a reading of the foregoing description. By way of example, while the shooting range shown includes a circular projectile deceleration chamber, other types of traps could be used, including, without limitation, the kind having an impact plate design. It should also be apparent that any rounded shape could be used as a projectile trap and the invention is not limited to just circular one sided shapes. Also, the deceleration chamber could be made from a series of plates having flat faces, such as shown in U.S. Pat. No. 5,811,718, issued to Bateman. Also, while an air injection system is shown, the present inventions could also be used with wet injection systems previously discussed above. All such modifications and improvements have not been included herein for the sake of conciseness and readability but may properly fall within the scope of the appended claims.

We claim:

1. A shooting range comprising:

(a) at least one shooting station; and (b) at least two projectile traps having a substantially rounded deceleration trap chamber aligned together transversely forming an uninterrupted chamber inlet and a continuous passage through said at least two projectile traps and joined together along adjacent end plate sidewalls extending into said projectile traps, wherein a front edge of the joint between said projectile traps includes a backwardly transposed portion substantially out of view from said shooting station and wherein said end plate sidewalls extend downward from the joint between said projectile traps into said trap chamber and terminate with a near vertical edge through and towards the back of said trap chamber.

2. The shooting range according to claim 1, further including at least one range auxiliary system.

3. The shooting range according to claim 2, wherein the range auxiliary system is a targeting system.

4. The shooting range according to claim 2, wherein the range auxiliary system is a containment system.

5. The shooting range according to claim 4, wherein the containment system includes side walls, a safety ceiling and overhead baffles.

6. The shooting range according to claim 2, wherein the range auxiliary system is an HVAC system.

7. The shooting range according to claim 1, wherein the shooting station includes a firing position.

8. The shooting range according to claim 7, wherein the shooting station further includes a shooting booth.

9. The shooting range according to claim 8, wherein the shooting booth includes a weapon rest and at least one lane divider.

10. An improved projectile trap for a shooting range having at least one shooting station comprising:

(a) at least two projectile trap subassemblies each having at least one end plate sidewall extending into said projectile trap subassemblies and adapted to join said at least two projectile trap subassemblies and to provide support at a distal end of each projectile trap subassembly;

(b) a trap guide for directing a projectile into said projectile trap subassemblies; and (c) a substantially rounded deceleration trap chamber in each of said projectile trap assemblies substantially perpendicular to said trap guide and having a continuous passage through said at least two trap subassemblies parallel to said trap guide, wherein a portion of a front end of the joint formed by joining together adjacent end plates between said projectile trap subassemblies is transposed into said trap chambers substantially out of view from said shooting station and said at least one end plate sidewall extends downward from the joint between said projectile trap subassemblies into said trap chamber and terminates with a near vertical edge through and towards the back of said trap chamber, and wherein said transposed portion of the front edge of the joint between said projectile trap subassemblies is not protected by said trap guide.

11. The projectile trap according to claim 10, wherein said transposed portion of the front edge of the joint between said projectile trap subassemblies is about 90° downstream from the entrance to said trap chamber.

12. The projectile trap according to claim 10, wherein the trap guide includes at least one pair of opposed ramps.

13. The projectile trap according to claim 12, wherein the angle of each ramp is between about 5° and 25° from horizontal.

14. The projectile trap according to claim 10, wherein end plates are joined together by at least one fastener assembly.

15. The projectile trap according to claim 10, further including a seam protector attached to the intersection of the exposed and displaced seam surface between adjacent end plates.

16. The projectile trap according to claim 15, wherein the seam protector is an overlapping abrasion resistant plate.

17. The projectile trap according to claim 10, wherein each of the trap chambers is a deceleration chamber.

18. The projectile trap according to claim 17, wherein each of the trap chambers includes an inlet and inner curved surface for receiving the projectile wherein the velocity of the projectile is reduced by contact with the inner surface.

19. The projectile trap according to claim 18, further including an exit for decelerated projectiles.

20. The projectile trap according to claim 19, further including a projectile retrieval system.

21. The projectile trap according to claim 10, further including at least one secondary support for supporting a portion of the projectile trap.

22. The projectile trap according to claim 10, further including an air injection system and an air collection system positioned downstream of the air injection system for receiving at least a portion of the air from the air injection system.

23. The projectile trap according to claim 22, wherein the air injection system includes an air supply and at least one air outlet.

24. The projectile trap according to claim 23, wherein the at least one air outlet includes a plurality of spaced apart air outlets.

25. The projectile trap according to claim 24, wherein the plurality of spaced apart air outlets are slots.

26. The projectile trap according to claim 23, wherein the at least one air outlet is oriented towards the trap chamber.

27. The projectile trap according to claim 22, wherein the air collection system includes at least one air inlet.

28. The projectile trap according to claim 27, wherein the at least one air inlet includes a plurality of spaced apart air inlets.

29. The projectile trap according to claim 28, wherein the plurality of spaced apart air inlets are slots.

30. The projectile trap according to claim 27, wherein the at least one air inlet is oriented towards the trap chamber.

31. The projectile trap according to claim 22, wherein the air collection system further includes at least one exhaust fan.

32. The projectile trap according to claim 31, wherein the operating CFM of the air collection system is greater than or equal to the operating CFM of the air injection system.

33. The projectile trap according to claim 22, wherein the air collection system further includes at least one air filter.

34. A shooting range comprising:

(a) at least one shooting station;

(b) a projectile trap including (i) at least two projectile trap subassemblies each having at least one end plate sidewall extending into said projectile trap subassemblies and adapted to join said at least two projectile trap subassemblies and to provide support at a distal end of each projectile trap subassembly and joined together along adjacent end plates, (ii) a trap guide for directing a projectile into said projectile trap subassemblies and (iii) a substantially rounded deceleration trap chamber in each of said projectile subassemblies substantially perpendicular to said trap guide, wherein a portion of a front edge of the joint formed by joining together adjacent end plates between said trap subassemblies is transposed into said trap chambers substantially out of view from said shooting station and said at least one end plate sidewall extends downward from the joint between said projectile trap subassemblies into said trap chamber and terminates with a near vertical edge through and towards the back of said trap chamber, and wherein said transposed portion of the front edge of the joint between said projectile trap subassemblies is the portion not protected by said trap guide; and (c) at least one range auxiliary system.

35. The shooting range according to claim 34, wherein the range auxiliary system is a targeting system.

36. The shooting range according to claim 34, wherein the range auxiliary system is a containment system.

37. The shooting range according to claim 36, wherein the containment system includes side walls, a safety ceiling and overhead baffles.

38. The shooting range according to claim 34, wherein the range auxiliary system is an HVAC system.

39. The shooting range according to claim 34, wherein the shooting station includes a firing position.

40. The shooting range according to claim 39, wherein the shooting station further includes a shooting booth.

41. The shooting range according to claim 40, wherein the shooting booth includes a weapons rest and at least one lane divider.

42. The projectile trap according to claim 34, wherein said transposed portion of the front edge of the joint between said projectile trap subassemblies is about 90° downstream from the entrance to said trap chamber.

43. The projectile trap according to claim 34, wherein the trap guide includes at least one pair of opposed ramps.

44. The projectile trap according to claim 43, wherein the angle of each ramp is between about 5° and 25° from horizontal.

45. The projectile trap according to claim 34, wherein end plates are joined together by at least one fastener assembly.

46. The projectile trap according to claim 34, further including a seam protector attached to the intersection of the exposed and displaced seam surface between adjacent end plates.

47. The projectile trap according to claim 46, wherein the seam protector is an overlapping abrasion resistant plate.

48. The projectile trap according to claim 34, wherein each trap chambers is a deceleration chamber.

49. The projectile trap according to claim 48, wherein each of the deceleration chambers includes an inlet and inner curved surface for receiving the projectile wherein the velocity of the projectile is reduced by contact with the inner surface.

50. The projectile trap according to claim 49, further including an exit for decelerated projectiles.

51. The projectile trap according to claim 50, further including a projectile retrieval system.

52. The projectile trap according to claim 34, further including at least one secondary support for supporting a portion of the projectile trap.

53. The projectile trap according to claim 34, further including an air injection system and an air collection system positioned downstream of the air injection system for receiving at least a portion of the air from the air injection system.

54. The projectile trap according to claim 53, wherein the air injection system includes an air supply and at least one air outlet.

55. The projectile trap according to claim 54, wherein the at least one air outlet includes a plurality of spaced apart air outlets.

56. The projectile trap according to claim 55, wherein the plurality of spaced apart air outlets are slots.

57. The projectile trap according to claim 54, wherein the at least one air outlet is oriented towards the trap chamber.

58. The projectile trap according to claim 53, wherein the air collection system includes at least one air inlet.

59. The projectile trap according to claim 58, wherein the at least one air inlet includes a plurality of spaced apart air inlets.

60. The projectile trap according to claim 59, wherein the plurality of spaced apart air inlets are slots.

61. The projectile trap according to claim 58, wherein the at least one air inlet is oriented towards the trap chamber.

62. The projectile trap according to claim 53, wherein the air collection system further includes at least one exhaust fan.

63. The projectile trap according to claim 62, wherein the operating CFM of the air collection system is greater than or equal to the operating CFM of the air injection system.

64. The projectile trap according to claim 53, wherein the air collection system further includes at least one air filter.

* * * * *

UNITED STATES PATENT AND TRADEMARK OFFICE

CERTIFICATE OF CORRECTION

PATENT NO. : 8,459,651 B1
APPLICATION NO. : 12/726996
DATED : June 11, 2013
INVENTOR(S) : Nester et al.

It is certified that error appears in the above-identified patent and that said Letters Patent is hereby corrected as shown below:

In the Specification:

In Column 2, Line 37, the word including should be "include"

In Column 5, Line 26, the second occurrence of 10b should be "10c"

In Column 5, line 39, the word chambers should be "chamber"

Signed and Sealed this
Seventeenth Day of September, 2013

Teresa Stanek Rea
*Deputy Director of the United States Patent and Trademark Office*